US008394740B2

(12) United States Patent
Etoh et al.

(10) Patent No.: US 8,394,740 B2
(45) Date of Patent: Mar. 12, 2013

(54) THERMOSENSITIVE RECORDING MATERIAL

(75) Inventors: Akinori Etoh, Ichihara (JP); Tomokazu Ishizuka, Ichihara (JP)

(73) Assignee: Mitsui Chemicals, Inc., Tokyo (JP)

( * ) Notice: Subject to any disclaimer, the term of this patent is extended or adjusted under 35 U.S.C. 154(b) by 448 days.

(21) Appl. No.: 12/682,421

(22) PCT Filed: Oct. 2, 2008

(86) PCT No.: PCT/JP2008/067964

§ 371 (c)(1),
(2), (4) Date: Apr. 9, 2010

(87) PCT Pub. No.: WO2009/048016

PCT Pub. Date: Apr. 16, 2009

(65) Prior Publication Data

US 2010/0248958 A1 Sep. 30, 2010

(30) Foreign Application Priority Data

Oct. 10, 2007 (JP) ..... 2007-264342

(51) Int. Cl.
*B41M 5/42* (2006.01)

(52) U.S. Cl. ..... 503/226

(58) Field of Classification Search ..... None
See application file for complete search history.

(56) References Cited

U.S. PATENT DOCUMENTS

| | | | |
|---|---|---|---|
| 5,210,066 | A | 5/1993 | Sakurai et al. |
| 2003/0045427 | A1 | 3/2003 | Sakurai et al. |
| 2008/0071039 | A1 | 3/2008 | Etoh et al. |

FOREIGN PATENT DOCUMENTS

| | | | |
|---|---|---|---|
| EP | 0436390 | B1 | 3/1997 |
| JP | 05-069665 | A | 3/1993 |
| JP | 2953630 | B2 | 7/1999 |
| JP | 2001-270251 | A | 10/2001 |
| JP | 2003-182216 | | 7/2003 |
| JP | 2005-154914 | A | 6/2005 |
| JP | 2005-320463 | A | 11/2005 |
| WO | WO 01/53108 | A1 | 7/2001 |
| WO | WO 2006/028111 | A1 | 3/2006 |

OTHER PUBLICATIONS

Supplementary European Search Report EP 08 83 7908 dated Aug. 31, 2012.

International Search Report mailed Dec. 22, 2008 received in PCT/JP2008/067964.

*Primary Examiner* — Bruce H Hess
(74) *Attorney, Agent, or Firm* — Foley & Lardner LLP

(57) ABSTRACT

The present invention provides a material that is less likely to cause flex cracking, has high scratch resistance, and is suitable for a protective layer for a thermosensitive material. A thermosensitive recording material according to the present invention includes a base, a thermosensitive recording layer formed on the base, and a protective layer formed on the thermosensitive recording layer, wherein the protective layer is formed from a mixture that contains an emulsion (a) containing particles formed of a hydrophobic polymer (1) and a hydrophilic polymer (2); and a non-crosslinking urea compound (b). Preferably, the hydrophobic polymer (1) contains an acrylonitrile-derived constitutional unit. Preferably, the non-crosslinking urea compound (b) is urea or a urea derivative.

6 Claims, No Drawings

THERMOSENSITIVE RECORDING MATERIAL

TECHNICAL FIELD

The present invention relates to a thermosensitive recording material.

BACKGROUND ART

Thermosensitive recording materials, which include a thermosensitive recording layer on a base, such as paper or a plastic film, have been widely used as output sheets of facsimile machines, industrial measurement terminals, medical terminals, hand-held terminals, POS systems, and discovery systems.

In thermosensitive recording materials, in order to protect a thermosensitive recording layer from water, plasticizers, fats and oils, solvents, and the like, a protective layer is generally formed on the thermosensitive recording layer.

For example, (meth)acrylamide copolymer emulsions have been investigated as materials used for such a protective layer (see, for example, Patent Documents 1, 2, and 3). Although protective layers formed from these conventional (meth)acrylamide copolymer emulsions have high water resistance, solvent resistance, and heat resistance, the protective layers sometimes suffer from flex cracking, and there is room for improvement in the scratch resistance thereof.

[Patent Document 1] JP Patent No. 295630

[Patent Document 2] International Publication WO 2001/053108

[Patent Document 3] International Publication WO 2006/028111

DISCLOSURE OF INVENTION

Problems to be Solved by the Invention

It is an object of the present invention to provide a material that is less likely to cause flex cracking, has high scratch resistance, and is suitable for a protective layer for a thermosensitive material.

Means for Solving the Problems

As a result of investigations of the problems described above, the present inventors completed the present invention by finding that a protective layer for a thermosensitive material formed of a mixture of an emulsion containing polymer particles formed of a particular polymer and a particular urea compound easily follows the deformation of a base, is less likely to cause flex cracking, and has high scratch resistance because the protective layer is pliable and flexible.

A thermosensitive recording material according to the present invention includes a base, a thermosensitive recording layer formed on the base, and a protective layer formed on the thermosensitive recording layer, wherein the protective layer is formed from a mixture that contains an emulsion (a) containing particles formed of a hydrophobic polymer (1) and a hydrophilic polymer (2); and a non-crosslinking urea compound (b).

Preferably, the hydrophobic polymer (1) contains an acrylonitrile-derived constitutional unit. Preferably, the hydrophilic polymer (2) contains a methacrylamide-derived constitutional unit.

Preferably, the thermosensitive recording material contains 1 to 50 parts by weight of the non-crosslinking urea compound (b) per 100 parts by weight in total of the hydrophobic polymer (1) and the hydrophilic polymer (2).

Preferably, the non-crosslinking urea compound (b) used in the thermosensitive recording material is urea or a urea derivative. Examples of the urea derivative include monoalkylureas, dialkylureas, hydroxyalkylureas, and biuret.

Advantages

A thermosensitive recording material according to the present invention not only has high water resistance, solvent resistance, and heat resistance, but also is less likely to cause flex cracking and has high scratch resistance because a protective layer thereof is pliable and flexible.

BEST MODES FOR CARRYING OUT THE INVENTION

A thermosensitive recording material according to the present invention is characterized by a material for a protective layer formed on a thermosensitive recording layer.

The material for a protective layer contains an emulsion (a) and a non-crosslinking urea compound (b). The emulsion (a) is characterized by containing particles formed of a hydrophobic polymer (1) and a hydrophilic polymer (2).

Hydrophobic Polymer (1)

The hydrophobic polymer (1) is a polymer having a low affinity for aqueous solvents. Examples of hydrophobic monomers (c) for the hydrophobic polymer include methyl (meth)acrylate, ethyl (meth)acrylate, butyl (meth)acrylate, 2-ethylhexyl (meth)acrylate, lauryl (meth)acrylate, aromatic vinyl monomers, such as styrene, α-methylstyrene, and divinylbenzene, monomers containing a nitrile group, such as (meth)acrylonitrile, α-olefins, such as ethylene and propylene, and dienes, such as butadiene. These hydrophobic monomers (c) are used alone or in combination.

The hydrophobic polymer (1) may be copolymerized with a hydrophilic monomer (d), such as acrylic acid, methacrylic acid, 2-hydroxyethyl methacrylate, or vinylpyrrolidone, without diminishing hydrophobicity.

The hydrophobic polymer (1) contains a constitutional unit derived from the hydrophobic monomer (c) and has a low affinity for aqueous solvents used in emulsions. Preferably, the hydrophobic polymer (1) contains 50% by weight or more constitutional unit derived from the hydrophobic monomer (c).

The amount of hydrophobic monomer (c) generally ranges from 50 to 99 parts by weight, preferably from 60 to 99 parts by weight, more preferably from 70 to 99 parts by weight, per 100 parts by weight of solids in the monomer components constituting the hydrophobic polymer (1).

An amount of hydrophobic monomer (c) outside this range tends to result in unstable particles.

The amount of monomer(s) other than the hydrophobic monomer (c) generally ranges from 1 to 50 parts by weight, preferably from 1 to 40 parts by weight, more preferably from 1 to 30 parts by weight, per 100 parts by weight of solids in the monomer components constituting the hydrophobic polymer (1).

Preferably, the hydrophobic polymer (1) contains an acrylonitrile-derived constitutional unit. A hydrophobic polymer (1) containing an acrylonitrile-derived constitutional unit is hereinafter referred to as a hydrophobic acrylonitrile polymer. Preferably, the hydrophobic acrylonitrile polymer is a polymer that contains 10% by weight or more acrylonitrile-derived constitutional unit.

The amount of acrylonitrile generally ranges from 10 to 90 parts by weight, preferably from 20 to 80 parts by weight, more preferably from 40 to 70 parts by weight, per 100 parts by weight of solids in the monomer components constituting the hydrophobic acrylonitrile polymer.

An amount of acrylonitrile within these ranges tends to result in high water resistance and plasticizer resistance of the protective layer.

The amount of monomers other than acrylonitrile generally ranges from 10 to 90 parts by weight, preferably from 20 to 80 parts by weight, more preferably from 30 to 60 parts by weight, per 100 parts by weight of solids in the monomer components constituting the hydrophobic polymer (1).

The hydrophobic polymer (1) generally has a glass transition point in the range of −20° C. to 90° C., preferably 0° C. to 70° C. The glass transition point below −20° C. may result in low heat resistance of the protective layer. The glass transition point above 90° C. results in low pliability of the protective layer and may result in cracking of the protective layer, impairing the storage stability of the thermosensitive recording layer.

The hydrophobic polymer (1) may have any average particle size (number average), provided that the hydrophobic polymer (1) can be used in a thermosensitive recording material according to the present invention, and preferably has an average particle size (number average) in the range of 20 to 500 nm, more preferably 70 to 300 nm. An excessively small average particle size may result in very high viscosity of the emulsion. In this case, the resin content in the production must be reduced. This results in a long drying time of a coating solution for a protective layer and low productivity of a thermosensitive recording material according to the present invention. Thus, an excessively small average particle size is economically unfavorable. On the other hand, an excessively large average particle size may result in very low gloss and may result in low storage stability of the thermosensitive recording layer because a dense protective layer is difficult to form thereon. The particle size can be altered with the molecular weight and the composition of the hydrophobic polymer (1) and a surfactant and is adjusted within the range described above.

The hydrophobic polymer (1) generally has a weight-average molecular weight in the range of 10,000 to 2,000,000, preferably 100,000 to 2,000,000, as determined by GPC.

Hydrophilic Polymer (2)

The hydrophilic polymer (2) is a polymer having a high affinity for aqueous solvents used in emulsions.

Preferably, the hydrophilic polymer (2) contains a methacrylamide-derived constitutional unit. A hydrophilic polymer (2) containing a methacrylamide-derived constitutional unit is hereinafter referred to as a hydrophilic methacrylamide polymer. Preferably, the hydrophilic methacrylamide polymer is a polymer that contains 30% by weight or more methacrylamide-derived constitutional unit.

The hydrophilic methacrylamide polymer is a polymer that is produced by copolymerization of monomer components composed of methacrylamide and an optional unsaturated monomer copolymerizable with methacrylamide.

The amount of methacrylamide generally ranges from 30 to 98 parts by weight, preferably 40 to 98 parts by weight, more preferably 50 to 95 parts by weight, per 100 parts by weight of solids in the monomer components constituting the hydrophilic methacrylamide polymer.

The amount of unsaturated monomer copolymerizable with methacrylamide generally ranges from 2 to 70 parts by weight, preferably 2 to 60 parts by weight, more preferably 5 to 50 parts by weight, per 100 parts by weight of solids in the monomer components constituting the hydrophilic methacrylamide polymer.

An amount of methacrylamide within these ranges tends to result in high running stability (heat resistance), plasticizer resistance, oil resistance, and solvent resistance of the protective layer.

An amount of methacrylamide below the lower limit may result in insufficient heat resistance, poor running stability, and insufficient plasticizer resistance of the protective layer.

An amount of methacrylamide above the upper limit may result in a deterioration in stabilization (protective colloid) function, leading to very high viscosity or even aggregation in the production of particles.

Examples of the unsaturated monomer copolymerizable with methacrylamide optionally used in the present invention include (meth)acrylates, such as methyl (meth)acrylate, ethyl (meth)acrylate, butyl (meth)acrylate, 2-ethylhexyl (meth) acrylate, 2-hydroxyethyl (meth)acrylate, 2-hydroxypropyl (meth)acrylate, 2-aminoethyl (meth)acrylate, 2-(N-methylamino)ethyl (meth)acrylate, 2-(N,N-dimethylamino)ethyl (meth)acrylate, and glycidyl (meth)acrylate, vinyl esters, such as vinyl acetate and vinyl propionate, monomers containing a nitrile group, such as (meth)acrylonitrile, unsaturated carboxylic acids, such as (meth)acrylic acid, maleic anhydride, fumaric acid, itaconic acid, and crotonic acid, aromatic vinyl monomers, such as styrene, α-methylstyrene, and divinylbenzene, and N-substituted unsaturated carboxylic acid amides, such as N-methylol(meth)acrylamide. Among others, unsaturated monomers having functional groups, such as a carboxy group, a hydroxy group, an amino group, a methylol group, and a glycidyl group, are preferably used.

These unsaturated monomers are used alone or in combination.

The hydrophilic methacrylamide polymer generally has a weight-average molecular weight in the range of 5,000 to 500,000, preferably 10,000 to 300,000, as determined by GPC.

Method for Producing Particles

Preferably, the particles composed of the two polymers used in the present invention have a structure in which the hydrophilic polymer (2) is substantially distributed on the surface of the hydrophobic polymer (1). The structure in which the hydrophilic polymer (2) is substantially distributed on the surface of the hydrophobic polymer (1) may be a structure in which the hydrophilic polymer (2) is present on part of the surface of the hydrophobic polymer (1) or a two-layer structure in which the surface of the hydrophobic polymer (1) is entirely covered with the hydrophilic polymer (2). One aspect of the particles composed of the two polymers used in the present invention is particles in which the hydrophobic polymer (1) forms a core, and the hydrophilic polymer (2) forms a shell. The particles may contain particles only composed of the hydrophilic polymer (2) or particles only composed of the hydrophobic polymer (1) without compromising the object of the present invention.

The particles may be produced by any method provided that the particles composed of the two polymers are produced. Examples of the method include a method in which the hydrophobic polymer (1) and the hydrophilic polymer (2) are produced simultaneously, a method in which the hydrophobic polymer (1) and the hydrophilic polymer (2) individually produced are mixed, a method in which the hydrophobic polymer (1) is produced, and then the hydrophilic polymer (2) is produced in the presence of the hydrophobic polymer (1), and a method in which the hydrophilic polymer (2) is produced, and then the hydrophobic polymer (1) is produced in the presence of the hydrophilic polymer (2).

The weight ratio (solid content) of the hydrophobic polymer (1) to the hydrophilic polymer (2) generally ranges from 100 parts by weight of the hydrophobic polymer (1) to 20 to 200 parts by weight, preferably 50 to 150 parts by weight, of the hydrophilic polymer (2).

An excessively small amount of hydrophilic polymer (2) may result in low polymerization stability, which may lead to the formation of a large amount of aggregate in the production of the hydrophobic polymer (1), and a deterioration in the heat resistance of the protective layer, which is one of the most essential physical properties in the present invention. On the other hand, at an excessively large amount of hydrophilic polymer (2), a polymer component in the emulsion (a) tends to be very hard and brittle. Thus, the resulting protective layer may have insufficient pliability even when the glass transition point of an unsaturated monomer of the hydrophobic polymer (1) is altered.

In the production of the hydrophobic polymer (1) or the hydrophilic polymer (2), a surfactant or a water-soluble polymer may be appropriately used to impart polymerization stability and storage stability.

Examples of the surfactant include anionic surfactants, cationic surfactants, and nonionic surfactants.

Examples of the water-soluble polymer include poly(vinyl alcohol) and poly(ethylene glycol).

Although the amounts of surfactant and water-soluble polymer are not limited, they are preferably minimized in consideration of the water resistance of the polymer.

Examples of a polymerization initiator used in the production of the hydrophobic polymer (1) or the hydrophilic polymer (2) include persulfates, such as ammonium persulfate, water-soluble initiators, such as 4,4'-azobis(4-cyanovaleric acid) and hydrogen peroxide, oil-soluble initiators, such as benzoyl peroxide and azobisisobutyronitrile, and redox initiators. The amount of polymerization initiator is not limited and may be determined in accordance with a known technique. The amount of initiator used in the copolymerization of monomer components containing methacrylamide generally ranges from 0.1 to 10 parts by weight, preferably 0.1 to 5 parts by weight, per 100 parts by weight (solid content) of the monomer components.

A molecular weight modifier (chain transfer agent), for example, a mercaptan, such as t-dodecyl mercaptan or n-dodecyl mercaptan, or a low-molecular-weight halide is also used if necessary.

In the present invention, a base is used as a neutralizing agent to impart water solubility to the hydrophilic polymer (2). After the formation of the hydrophobic polymer (1), a neutralizing agent is also used to control the pH of the emulsion (a). Examples of the neutralizing agent include (aqueous) ammonia. Although other examples of the neutralizing agent include sodium hydroxide, potassium hydroxide, and various amines, these neutralizing agents may result in low water resistance, damage to thermal heads, or desensitization in thermal coloring. Use of (aqueous) ammonia does not cause these negative effects. In addition, since (aqueous) ammonia can be removed at relatively low temperature, water resistance after the formation of the protective layer advantageously appears in a short period of time. The pH is not limited and preferably ranges from 7 to 10 in view of the storage stability of the emulsion (a) and mechanical stability.

If necessary, a cross-linking monomer may be used. Examples of the cross-linking monomer include methylenebis(meth)acrylamide, divinylbenzene, and di(meth)acrylates containing a poly(ethylene glycol) chain.

The polymerization temperature in the production of a polymer is not limited and preferably ranges from 30° C. to 95° C., particularly preferably 50° C. to 85° C., in view of the production time and the conversion (reaction rate) from monomers to a copolymer.

The emulsion (a) may have any viscosity and preferably has a viscosity in the range of 5 to 10,000 mPa·s at a solid content of 20%, as determined with a BM-type viscometer (rotor Nos. 1 to 4, 60 revolutions, temperature 25° C.).

The particles composed of the two polymers used in the present invention may have any average particle size (number average), provided that the particles can be used in a thermosensitive recording material according to the present invention, and preferably have an average particle size (number average) in the range of 50 to 800 nm, more preferably 100 to 800 nm.

An excessively small average particle size tends to result in a high emulsion viscosity and a deterioration in workability. On the other hand, an excessively large average particle size tends to result in low dispersion stability and the precipitation of the particles.

Non-Crosslinking Urea Compound

A protective layer used in the present invention is formed from a mixture containing the emulsion (a) and the non-crosslinking urea compound (b).

The non-crosslinking urea compound refers to a urea compound other than a compound that can react with a functional group (for example, a carboxy group) that may be contained in the two polymers forming the particles to form a cross-linked structure typified by a urea compound such as dimethylolurea to be used as cross-linker.

Examples of the non-crosslinking urea compound (b) include urea and urea derivatives, such as monoalkylureas, dialkylureas, hydroxyalkylureas, and biuret.

A protective layer that contains the non-crosslinking urea compound tends to have pliability and flexibility. Among others, urea is particularly preferred because of its high solubility in water and accordingly in emulsion.

The proportion of the non-crosslinking urea compound generally ranges from 1 to 50 parts by weight, preferably 5 to 45 parts by weight, more preferably 5 to 40 parts by weight, per 100 parts by weight in total (solid content) of the hydrophobic polymer (1) and the hydrophilic polymer (2) in the emulsion (a).

The proportion of the non-crosslinking urea compound within these ranges tends to result in sufficient pliability and flexibility of the protective layer. Furthermore, the protective layer tends to have high scratch resistance.

The proportion of the non-crosslinking urea compound below the lower limit may result in insufficient pliability and flexibility of the protective layer. Furthermore, the protective layer tends to have low scratch resistance.

The proportion of the non-crosslinking urea compound above the upper limit may result in a deterioration in the water resistance of the protective layer.

Thermosensitive Recording Material

A thermosensitive recording material according to the present invention comprises a base, a thermosensitive recording layer formed on the base, and a protective layer formed on the thermosensitive recording layer, wherein the protective layer is formed from a mixture that contains an emulsion (a)

containing particles formed of a hydrophobic polymer (1) and a hydrophilic polymer (2); and a non-crosslinking urea compound (b).

By the addition of the non-crosslinking urea compound (b), the protective layer tends to have pliability and flexibility. Furthermore, the protective layer tends to have high scratch resistance.

Thus, use of a mixture of the emulsion (a) and the non-crosslinking urea compound (b) as a protective layer of a thermosensitive recording material tends to improve the water resistance, the solvent resistance, and the heat resistance of the thermosensitive recording material. In addition, the thermosensitive recording material is less likely to cause flex cracking and tends to have improved scratch resistance.

Examples of the base generally include paper and plastic sheets and films. The thermosensitive recording layer is, but not limited to, a known thermosensitive recording layer. The thermosensitive recording layer may be underlaid with an undercoat layer.

The protective layer is generally formed by application to the thermosensitive recording layer with an air-knife coater, a gravure coater, a roll coater, or another coater at a dry weight in the range of 1 to 10 g/m$^2$.

In the present invention, the protective layer may contain filler if necessary. The amount of filler is not limited, and the type and amount of filler can be appropriately determined without compromising the object of the present invention. Examples of the filler include inorganic fillers, such as calcium carbonate, magnesium carbonate, kaolin, talc, clay, aluminum hydroxide, barium sulfate, silicon oxide, titanium oxide, zinc oxide, and colloidal silica, and organic fine particles, such as a urea-formalin resin and a polystyrene fine powder. These fillers are used alone or in combination.

Examples of optional components other than filler include water resistance improvers (cross-linkers), lubricants for improving running stability (heat resistance and antisticking), such as higher fatty acid metal salts, higher fatty acid amides, and low-molecular-weight polyolefin fine particles, ultraviolet absorbers, antioxidants, antifoaming agents, wetting agents, viscosity control agents, and other aids and additive agents.

Among others, water resistance improvers (cross-linkers) are suitably used because the water resistance improvers (cross-linkers) can further improve the robustness of a protective layer, the durability of a thermosensitive layer and a recorded image, and thermal head suitability (sticking and running stability). Examples of the cross-linkers include glyoxal, dimethylolurea, glycidyl ethers of polyhydric alcohols, ketene dimers, dialdehyde starch, epichlorohydrin-modified polyamideamine, ammonium zirconium carbonate, aluminum sulfate, calcium chloride, and boric acid.

If necessary, another known aqueous resin may also be used as a constituent material of a protective layer in the present invention. Examples of such a resin include natural resins (for example, sodium alginate, starch, casein, and cellulose) and synthetic resins. Among others, modified poly (vinyl alcohol) is preferred. Examples of modified poly(vinyl alcohol) include, but not limited to, carboxyl-modified, acetoacetyl-modified, epoxy-modified, silanol-modified, amino-modified, olefin-modified, amide-modified, and nitrile-modified poly(vinyl alcohol).

A protective layer in the present invention can be applied to not only the top of a thermosensitive recording layer or the back side of a base, but also any area that can improve the function of the protective layer.

A thermosensitive recording layer in the present invention may have any color forming system. Examples of the color forming system include a system that utilizes a leuco dye and an acidic substance, typically a phenolic substance, a system that utilizes an imino compound and an isocyanate compound, and a system that utilizes a diazo compound and a coupler.

In order to impart a higher gloss and specular gloss to a protective layer in the present invention, a surface may be subjected to cast treatment, or a coating solution for a protective layer may be applied to a specular metallic drum or a flat PET film and, after drying, the coating layer may be transferred to a thermosensitive recording layer under pressure.

EXAMPLES

The present invention will be more specifically described below with reference to examples. However, the present invention is not limited to these examples. Unless otherwise specified, parts and % in the examples represent parts by weight and % by weight.

Production Example 1

A separable flask with an agitator and a reflux condenser was charged with 60 parts of deionized water, 0.1 parts of sodium dodecylbenzenesulfonate, and 1.0 part of potassium persulfate, was purged with nitrogen gas, and was heated to 70° C.

A monomer emulsion having the following composition was then continuously added to the flask for approximately four hours. Polymerization for approximately four hours yielded a seed emulsion (S-1) having a solid content of approximately 50%.

Composition of Monomer Emulsion

| | |
|---|---|
| Acrylonitrile | 20 parts |
| Methyl methacrylate | 36 parts |
| 2-ethylhexyl acrylate | 36 parts |
| 2-hydroxyethyl methacrylate | 5 parts |
| Methacrylic acid | 3 parts |
| Sodium dodecylbenzenesulfonate | 0.3 parts |
| Deionized water | 40 parts |

A separable flask with an agitator and a reflux condenser was charged with 1000 parts of the seed emulsion (S-1), 650 parts of deionized water, 95 parts of methacrylamide, and 155 parts of an aqueous solution in which 5 parts of methacrylic acid was previously dissolved in 150 parts of 0.5% aqueous ammonia, was purged with nitrogen gas, and was heated to 50° C. After methacrylamide was completely dissolved, the temperature was further increased to 70° C.

An aqueous solution containing 5 parts of ammonium persulfate in 100 parts of deionized water was then added to the flask. Polymerization for approximately three hours yielded a copolymer emulsion (EM-1) having a solid content of approximately 30%.

Production Example 2

A separable flask with an agitator and a reflux condenser was charged with 60 parts of deionized water, 0.1 parts of sodium dodecyl sulfate, and 1.0 parts of potassium persulfate, was purged with nitrogen gas, and was heated to 70° C.

A monomer emulsion having the following composition was then continuously added to the flask for approximately four hours. Polymerization for approximately four hours yielded a seed emulsion (S-2) having a solid content of approximately 50%.

Composition of Monomer Emulsion

| | |
|---|---|
| Acrylonitrile | 60 parts |
| Styrene | 5 parts |
| Butyl acrylate | 30 parts |
| 2-hydroxyethyl methacrylate | 2 parts |
| Methacrylic acid | 3 parts |
| n-dodecyl mercaptan | 0.1 parts |
| Sodium dodecylbenzenesulfonate | 0.3 parts |
| Deionized water | 40 parts |

A separable flask with an agitator and a reflux condenser was charged with 200 parts of the seed emulsion (S-2) and 300 parts of deionized water and was heated to 75° C.

After 2.0 parts of ammonium persulfate was added to the flask, a mixture of vinyl monomers and water having the following composition was continuously added to the flask with stirring for two hours. After additional two hours, the polymerization was completed. Cooling to 40° C. or less and adjusting to pH 8.0 with aqueous ammonia yielded a copolymer emulsion (EM-2) having a solid content of approximately 25%.

Mixture of Vinyl Monomers and Water

| | |
|---|---|
| Methacrylamide | 85 parts |
| 2-hydroxyethyl methacrylate | 5 parts |
| Acrylic acid | 10 parts |
| Deionized water | 200 parts |

Production Example 3

A separable flask with an agitator and a reflux condenser was charged with 100 parts of deionized water, was purged with nitrogen gas, and was heated to 80° C.

After 2.0 parts of ammonium persulfate was added to the flask, a mixture of vinyl monomers and deionized water having the following composition was continuously added to the flask with stirring for two hours. After additional two hours, the polymerization was completed. Cooling to 40° C. or less and adjusting to pH 7.0 with aqueous ammonia yielded an aqueous solution of a copolymer resin (A-1) having a solid content of approximately 25%.

Mixture of Vinyl Monomers and Water

| | |
|---|---|
| Methacrylamide | 55 parts |
| 2-hydroxyethyl methacrylate | 15 parts |
| Methacrylic acid | 20 parts |
| Sodium methallylsulfonate | 5 parts |
| Butyl acrylate | 5 parts |
| Deionized water | 200 parts |

Sixty parts of deionized water for adjusting the solid content was added to 800 parts of an aqueous solution of the copolymer resin (A-1). The temperature was again increased to 75° C. under nitrogen purge.

After 0.5 parts of 4,4'-azobis(4-cyanovaleric acid) was added, a vinyl monomer emulsion having the following composition was continuously added for three hours. After additional three hours, the polymerization was completed. Cooling to 40° C. or less and adjusting to pH 8.0 with aqueous ammonia yielded a milk white aqueous resin emulsion (EM-3) having a solid content of approximately 30%.

Vinyl Monomer Emulsion Composition

| | |
|---|---|
| Acrylonitrile | 70.0 parts |
| Butyl acrylate | 30.0 parts |
| Sodium dodecylbenzenesulfonate | 0.1 parts |
| Deionized water | 40.0 parts |

Evaluation Method (1) Evaluation of Running Stability

A pattern image of solid black printing was formed with a thermal printer (Ohkura Electric Co., Ltd.: TH-PMD) using the resulting thermosensitive paper under the following conditions. Loudness (crackles), the contamination of a head, and paper feeding were examined to evaluate the running stability of the thermosensitive paper on the basis of the following criteria.

Conditions

| | |
|---|---|
| Applied voltage | 24 V |
| Pulse width | 1.74 ms |
| Applied energy | 0.34 mj/dot |

Criteria

Good: No crackles, no head contamination, and excellent paper feeding.

Poor: Large crackles, head contamination, and poor paper feeding.

(2) Color Density

An image was formed under the same conditions as (1) using the resulting thermosensitive paper, and the density of the image was measured with a Macbeth densitometer (RD-918; manufactured by GretagMacbeth).

(3) Evaluation of Water Resistance

After a 140° C. heat block was pressed against the resulting thermosensitive paper for one second, a colored thermosensitive recording portion was rubbed 20 times with a piece of gauze containing water using a Gakushin-type rubbing fastness tester (under no-load condition). A loss in the thermosensitive recording portion was visually inspected to evaluate the water resistance of the thermosensitive paper on the basis of the following criteria.

Criteria

Good: No loss.

Fair: Although there is a slight loss, printed characters can be visually recognized.

Poor: There is a loss, and printed characters cannot be visually recognized.

(4) Plasticizer Resistance

After a 140° C. heat block was pressed against the resulting thermosensitive paper for one second, a transparent electrically insulating poly(vinyl chloride) adhesive tape (manufactured by Nitto Denko Co.) was attached to a colored thermosensitive recording portion. After leaving the thermosensitive paper to stand at 40° C. for 24 hours, the adhesive tape was removed, and the density after the attachment was measured with a Macbeth densitometer.

(5) Scratch Resistance

An uncolored portion of the resulting thermosensitive paper was rubbed 100 times with a piece of dry gauze using a Gakushin-type rubbing fastness tester (at a load of 100 gf). An aqueous solution of 20% isopropanol was applied to the rubbed portion. The appearance was visually inspected to evaluate the scratch resistance of the thermosensitive paper on the basis of the following criteria. In the presence of a scratch, the scratch is permeated with the alcohol to develop a color, allowing the presence of the scratch to be visible to the naked eye.

Criteria

Excellent: No scratch.

Good: A very few scratches.

Fair: Some scratches, but sufficient for practical use.

Poor: Many scratches and low scratch resistance.

(6) Flex Cracking Resistance

The resulting thermosensitive paper was wound around a rod having a diameter of 3 mm. An uncolored portion of the thermosensitive paper faced outward. An aqueous solution of 20% isopropanol was then applied to the uncolored portion of the thermosensitive paper. The appearance was visually inspected to evaluate the flex cracking resistance of the thermosensitive paper on the basis of the following criteria. In the presence of a crack, the crack is permeated with the alcohol to develop a color, allowing the presence of the crack to be visible to the naked eye.

Criteria

Excellent: No crack.

Good: A very few cracks.

Fair: Some cracks, but sufficient for practical use.

Poor: Many cracks and low flex cracking resistance.

Example 1

A hundred parts of the emulsion (EM-1) produced in Production Example 1 was mixed homogeneously with 101.1 parts of deionized water, 11.5 parts of an aqueous solution of 13% ammonium zirconium carbonate (manufactured by Daiichi Kigenso Kagaku Kogyo Co., Ltd., Zircosol AC-7) serving as a cross-linker, and 3 parts of 1,3-dimethylurea. Subsequent application of the mixture to a commercially available surface-untreated thermosensitive paper for word processors at a dry weight of 3 g/m$^2$ with a bar coater and drying (forced drying at 60° C. for 30 seconds, and subsequent aging in a 20° C./60% RH atmosphere for seven days) produced a thermosensitive paper. The resulting thermosensitive paper was evaluated as described above. Table 1 shows the results.

Example 2

A thermosensitive paper was produced in the same way as in Example 1 except that 89.7 parts of deionized water, 8.3 parts of 30% aqueous solution of epichlorohydrin-modified polyamideamine (manufactured by Mitsui Chemicals, Inc., Euramine P-5600) serving as a cross-linker, and 5 parts of urea were added to 100 parts of the emulsion (EM-2) produced in Production Example 2. The resulting thermosensitive paper was evaluated as described above. Table 1 shows the results.

Example 3

A thermosensitive paper was produced in the same way as in Example 1 except that 104.1 parts of deionized water, 10 parts of 30% aqueous solution of epichlorohydrin-modified polyamideamine (manufactured by Mitsui Chemicals, Inc., Euramine P-5600) serving as a cross-linker, and 1.5 parts of biuret were added to 100 parts of the emulsion (EM-3) produced in Production Example 3. The resulting thermosensitive paper was evaluated as described above. Table 1 shows the results.

Example 4

A thermosensitive paper was produced in the same way as in Example 2 except that 5 parts of urea used in Example 2 was replaced with 7.5 parts of urea. The resulting thermosensitive paper was evaluated as described above. Table 1 shows the results.

Example 5

A thermosensitive paper was produced in the same way as in Example 3 except that 1.5 parts of biuret used in Example 3 was replaced with 0.8 parts of urea and 0.8 parts of dimethylolurea. The resulting thermosensitive paper was evaluated as described above. Table 1 shows the results.

Comparative Example 1

A thermosensitive paper was produced in the same way as in Example 1 except that 63.5 parts of deionized water and 8.3 parts of 30% aqueous solution of epichlorohydrin-modified polyamideamine (manufactured by Mitsui Chemicals, Inc., Euramine P-5600) serving as a cross-linker were added to 100 parts of the emulsion (EM-2) produced in Production Example 2. The resulting thermosensitive paper was evaluated as described above. Table 1 shows the results.

Comparative Example 2

A thermosensitive paper was produced in the same way as in Example 1 except that 235.2 parts of deionized water, 19.2 parts of an aqueous solution of 13% ammonium zirconium carbonate (manufactured by Daiichi Kigenso Kagaku Kogyo Co., Ltd., Zircosol AC-7) serving as across-linker, and 5 parts of urea were added to 100 parts of the seed emulsion (S-1) produced in Production Example 1. The resulting thermosensitive paper was evaluated as described above. Table 1 shows the results.

TABLE 1

Evaluation results of thermosensitive paper

| | Example 1 | Example 2 | Example 3 | Example 4 | Example 5 | Comparative Example 1 | Comparative Example 2 |
|---|---|---|---|---|---|---|---|
| Production Example | EM-1 | EM-2 | EM-3 | EM-2 | EM-3 | EM-2 | S-1 |
| Running stability | Good | Good | Good | Good | Good | Good | Poor |
| Color density | 1.62 | 1.58 | 1.55 | 1.63 | 1.54 | 1.60 | 1.36 |
| Water resistance | Good | Good | Fair | Fair | Fair | Good | Poor |
| Plasticizer resistance | 0.98 | 1.47 | 1.49 | 1.47 | 1.46 | 1.45 | 0.55 |

TABLE 1-continued

| Evaluation results of thermosensitive paper | | | | | | | |
|---|---|---|---|---|---|---|---|
| | Example 1 | Example 2 | Example 3 | Example 4 | Example 5 | Comparative Example 1 | Comparative Example 2 |
| Scratch resistance | Good | Excellent | Good | Excellent | Fair | Poor | Poor |
| Flex cracking | Good | Excellent | Good | Excellent | Fair | Poor | Fair |

As clear from the results shown in Table 1, the thermosensitive recording materials according to the examples have excellent running stability, color density, water resistance, and plasticizer resistance. The thermosensitive recording materials according to the examples also have high scratch resistance. Furthermore, since pliability and flexibility are imparted to the protective layer, the flex cracking of the thermosensitive recording materials tends to rarely occur.

Industrial Applicability

A thermosensitive recording material according to the present invention not only has high water resistance, solvent resistance, and heat resistance, but also is less likely to cause flex cracking and has high scratch resistance. A thermosensitive recording material according to the present invention can therefore be suitably used for output sheets of facsimile machines, industrial measurement terminals, medical terminals, hand-held terminals, POS systems, and discovery systems.

The invention claimed is:

1. A thermosensitive recording material comprising:

a base; a thermosensitive recording layer formed on the base; and a protective layer formed on the thermosensitive recording layer, wherein the protective layer is formed from a mixture that contains an emulsion (a) containing particles formed of a hydrophobic polymer (1) and a hydrophilic polymer (2); and a non-crosslinking urea compound (b).

2. The thermosensitive recording material according to claim 1, wherein the hydrophobic polymer (1) contains an acrylonitrile-derived constitutional unit.

3. The thermosensitive recording material according to claim 1 or 2, wherein the hydrophilic polymer (2) contains a methacrylamide-derived constitutional unit.

4. The thermosensitive recording material according to claim 1, wherein the thermosensitive recording material contains 1 to 50 parts by weight of the non-crosslinking urea compound (b) per 100 parts by weight in total of the hydrophobic polymer (1) and the hydrophilic polymer (2).

5. The thermosensitive recording material according to claim 1, wherein the non-crosslinking urea compound (b) is urea or a urea derivative.

6. The thermosensitive recording material according to claim 1, wherein the non-crosslinking urea compound (b) is at least one compound selected from the group consisting of urea, monoalkylureas, dialkylureas, hydroxyalkylureas, and biuret.

* * * * *